US006530191B2

(12) United States Patent
Rieke et al.

(10) Patent No.: US 6,530,191 B2
(45) Date of Patent: Mar. 11, 2003

(54) SUPPORT PANEL FOR AIR HANDLING UNIT

(75) Inventors: Edward T. Rieke, McMinnville, TN (US); Michael W. Austin, McMinnville, TN (US)

(73) Assignee: Carrier Corporation, Farmington, CT (US)

( * ) Notice: Subject to any disclaimer, the term of this patent is extended or adjusted under 35 U.S.C. 154(b) by 19 days.

(21) Appl. No.: 09/904,671

(22) Filed: Jul. 13, 2001

(65) Prior Publication Data

US 2003/0009966 A1 Jan. 16, 2003

(51) Int. Cl.[7] ..... E04C 2/34

(52) U.S. Cl. ..... 52/794.1; 52/309.9; 52/309.11; 52/787.1; 428/178

(58) Field of Search ..... 52/309.8, 309.9, 52/309.11, 309.15, 784.15, 784.16, 787.1, 794.1, 795.1, 783.1, 787.11, 787.12; 248/678

(56) References Cited

U.S. PATENT DOCUMENTS

| | | | | |
|---|---|---|---|---|
| 2,180,177 A | | 11/1939 | Ternstrom | |
| 4,656,795 A | | 4/1987 | Albrecht et al. | |
| 5,279,089 A | * | 1/1994 | Gulur | 52/309.11 |
| 5,612,117 A | * | 3/1997 | Belanger et al. | 428/178 |
| 5,870,868 A | * | 2/1999 | Kita et al. | 52/309.9 |

FOREIGN PATENT DOCUMENTS

| | | |
|---|---|---|
| DE | 1917949 | 10/1970 |
| DE | 4422971 A1 | 1/1994 |
| EP | 0038015 A2 | 10/1981 |
| GB | 1127308 | 9/1968 |
| NL | 1014208 | 7/2001 |
| WO | 01/50068 A1 | 7/2001 |

* cited by examiner

*Primary Examiner*—Carl D. Friedman
*Assistant Examiner*—Steve M Varner
(74) *Attorney, Agent, or Firm*—Wall Marjama & Bilinski LLP

(57) ABSTRACT

A support panel for use in an air handling unit for both supporting equipment inside the unit and providing a thermal barrier to the flow of heat into and out of the unit. The panel includes a plastic frame that is enclosed by upper and lower covers to form an internal cavity. Support members are placed in the cavity between the covers to which equipment that is supported upon the panel can be secured. The support members are fabricated of a high strength composite material having a low thermal conductivity. A curable foam is then injected into the cavity to bond the panel components together in assembly. The frame, the support members and the curable foam all have a relatively low thermal conductivity and coact to create a thermal barrier to impede the flow of heat in or out of the unit.

8 Claims, 5 Drawing Sheets

SUPPORT PANEL FOR AIR HANDLING UNIT

FIELD OF THE INVENTION

This invention relates to a cover panel for use in an air handling unit for conducting air along an enclosed flow path, wherein the panel is able to support relatively heavy air handling equipment and the like while providing a thermal barrier to improve the flow of heat through said panel.

BACKGROUND OF THE INVENTION

Many air handling units in present day use are fabricated from thin sheet metal ducts that are brought together in the field to provide an enclosed passage through which air can be conducted. The walls of the duct section readily conduct heat and provide little in the way of a thermal barrier. Accordingly, heat can move rather rapidly through the walls from the warm side of the duct to the cool side. The loss of energy through the walls of the duct work places an unwanted load on the air handling equipment particularly when conditioned air is being conducted through the unit. When the air handling unit is installed in an unconditioned air space and is carrying cool air, the outer wall surfaces of the duct work will condense moisture and the moisture can drop onto the underlying floor areas posing a danger to people walking or working below the unit. By the same token, the moisture can also fall upon equipment producing corrosion and causing other moisture related problems.

Air handling equipment such as heat exchanger coils or fans oftentimes must be mounted within the air handling unit. This equipment can be relatively heavy and requires the installation of additional external supports beneath those areas in which the equipment is located. Generally, the addition of reinforcing supports to the duct work can be both costly and time consuming.

SUMMARY OF THE INVENTION

It is a primary object of the present invention to improve air handling units for conducting air along an enclosed path of travel.

It is a further object of the present invention to inhibit the flow of heat into or out of the duct work of an air handling unit.

A still further object of the present invention is to provide a reinforced floor panel for use in an air handling unit that is capable of forming a thermal barrier to impede the flow of heat from one side of the unit to the other, while at the same time providing the strength to support the weight of air handling equipment contained within the air handling unit.

These and other objects of the present invention are attained by a panel suitable for use in an air handling unit for supporting equipment contained within the unit while providing a thermal barrier to the transfer of energy into or out of the unit. The panel includes a rectangular frame having a top cover and a bottom cover so that an internal cavity is established within the panel. A plurality of reinforcing support members are mounted within the cavity. Each support member has a height equal to the depth of the cavity and includes a flat horizontally disposed platform that rests against one of the panel covers and a series of vertical walls extending downwardly from the top flange platform that rests against the opposing cover. The walls coact to form a series of chambers all of which open to one side or the other of the member. A curable foam material is injected into the cavity and fills the chambers in each support member and the entire cavity. The foam sets to bond the panel component together in assembly and to provide a thermal barrier to impede the flow of heat through the panel.

BRIEF DESCRIPTION OF THE DRAWING

For a better understanding of these and other objects of the present invention, reference will be made to the following detailed description of the invention which is to be read in association with the following drawings, wherein.

DETAILED DESCRIPTION OF THE INVENTION

Figure 1:
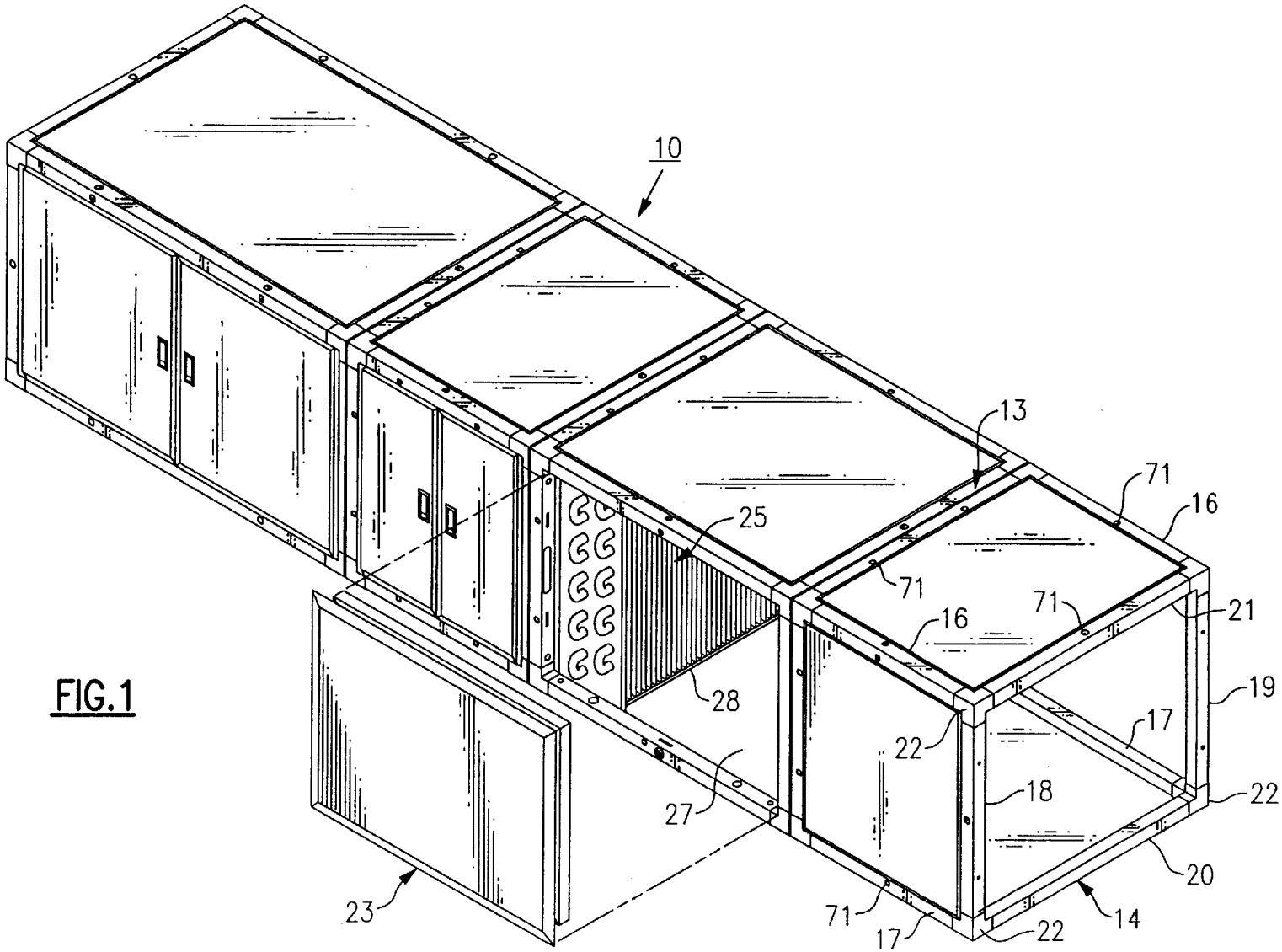
FIG. 1 is a perspective view of a portion of an air handling unit that embodies the teachings of the present invention.

Referring initially to FIG. 1 there is shown a portion of an air handling unit generally referenced 10, that embodies the teachings of the present invention. The air handling unit is made up of a series of rectangular shaped sections 12, each of which contains its own framework that includes a pair of end frames 13 and 14 that are joined together at the corner pieces 15. Horizontally disposed upper beams 16 and lower beams 17. Each end frame includes a pair of opposed side rails 18 and 19, a bottom rail 20 and a top rail 21. In assembly, the rails and the beams are slidably retained in the comer pieces 22 to form an open skeletal network, the openings of which are closed in assembly by means of panels that are inserted into the openings and locked in place by means of latching mechanisms contained within the beams and the rails.

The panels are constructed so that each panel acts as a thermal barrier for impeding the flow of heat into and out of the moving section. Although not shown, appropriate seals are also provided that prevent air from passing around the panels. All highly conductive thermal paths by which energy might pass freely into or out of the unit are essentially blocked due to the construction of each modular section.

As noted above, in many applications, equipment associated with the air handling unit must be mounted within the duct work. This equipment can be relatively heavy thus requiring additional strengthening of the unit in the areas where the equipment is mounted. Depending on the type of equipment involved, the equipment might typically be mounted upon a floor panel or a side panel. As will be explained in further detail below, reinforced panels embodying the present invention are provided to furnish the additional strength to support this type of equipment. These reinforced panels are compatible with the construction of the nodular sections and do not require further structural components to be added to the unit.

As illustrated in FIG. 1, one of the side panels 23 has been removed from the air handling unit to show a heat exchanger coil 25 mounted within the section with the pan 28 of the unit shown resting upon floor panel 27. Although the present invention will be explained with specific reference to the floor panel supporting a heat exchanger coil, it should be evident from the description of the invention below that the panel can be adapted to mount various pieces of equipment associated with air handling units without departing from the teachings of the inventions.

Figure 2:
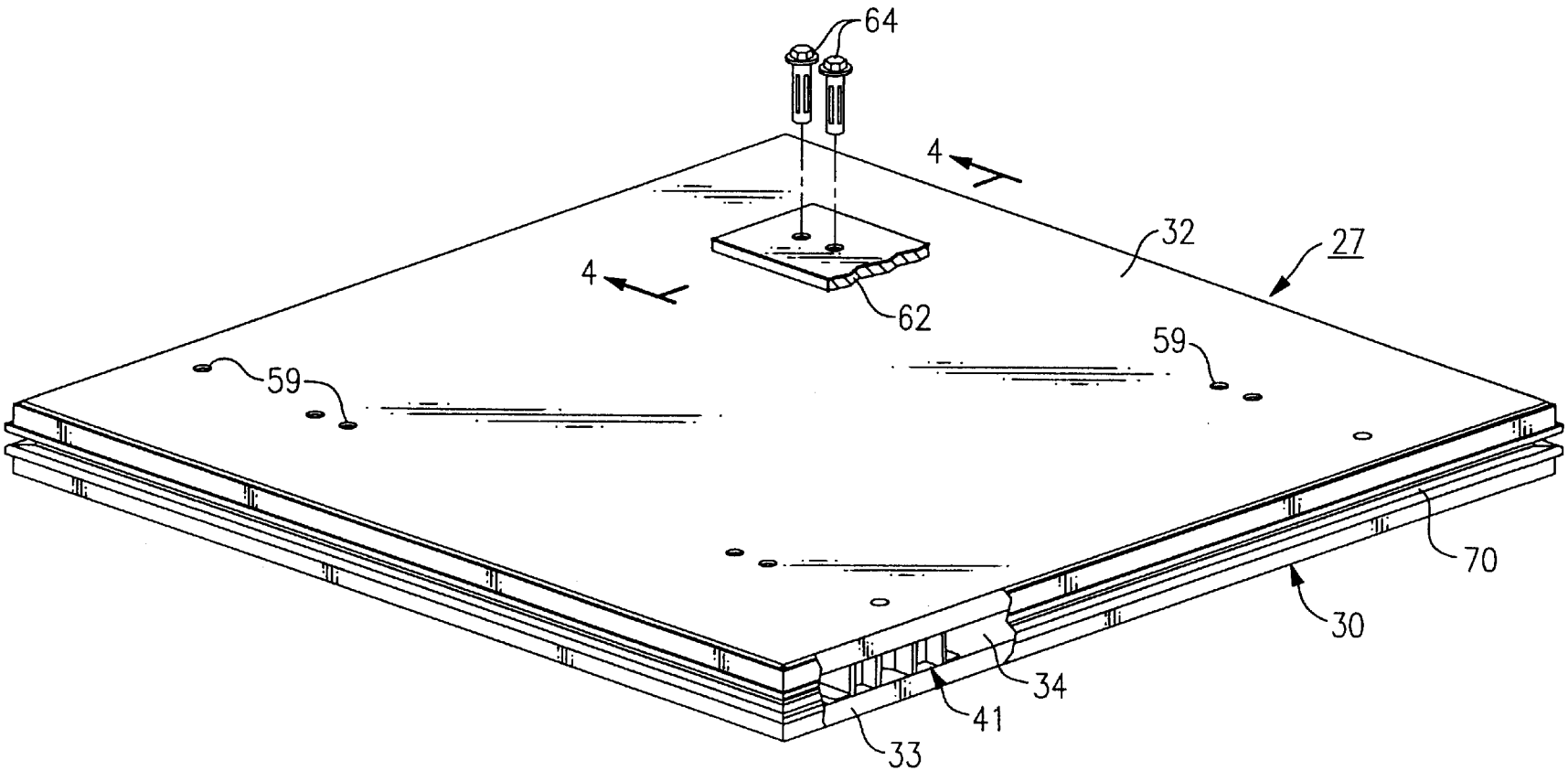
FIG. 2 is an enlarged perspective view of a panel embodying the teachings of the present invention.
Figure 3:
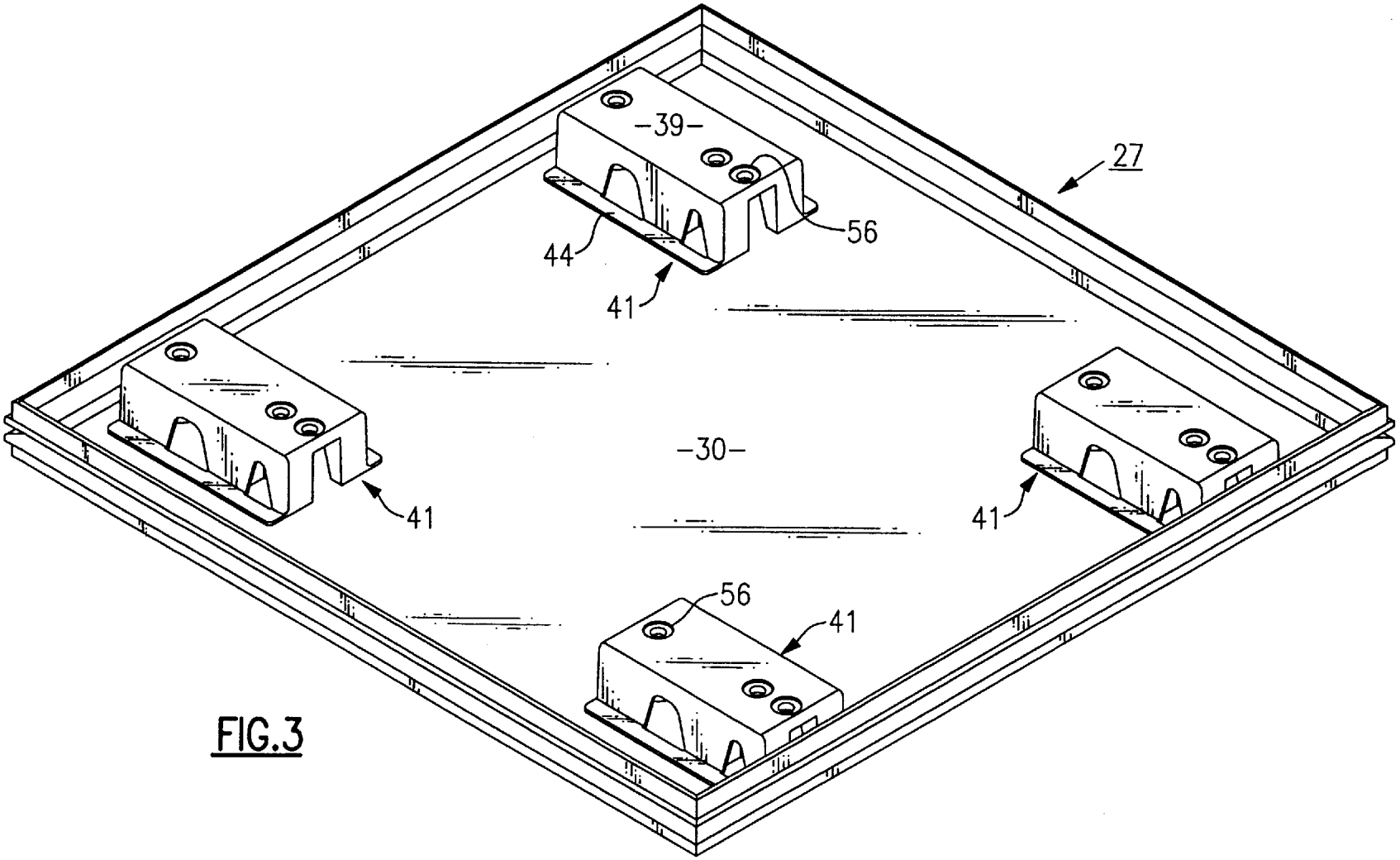
FIG. 3 is a view similar to that illustrated in FIG. 3 with the top cover removed to show a series of reinforcing support members contained within the panel.
Figure 4:
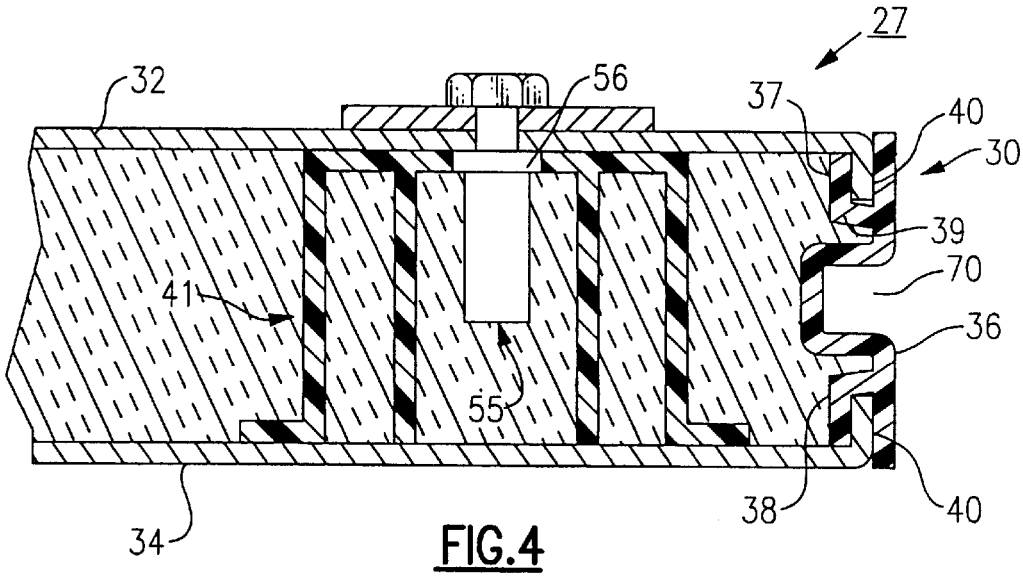
FIG. 4 is a sectional view taken along lines 4—4 in FIG. 2.

FIG. 2 illustrates the general construction of the floor panel 27. The panel includes a rectangular frame generally referenced 30 that is fabricated of a plastic material having a low thermal conductivity. The frame is closed by an upper cover 32 and a lower cover 33 to establish an enclosed cavity 34 within the panel. As best seen in FIG. 4, the side walls 36 of the panel frame are provided with upper and lower tabs 37 and 38 respectively that coact with the wall to establish slits 39 that extend about the entire perimeter of the frame. Each cover, in turn, contains an inwardly turned skirt 40 that surrounds the outer periphery of the covers and which is slidably received within one of the peripheral slits contained in the frame.

Figure 5:
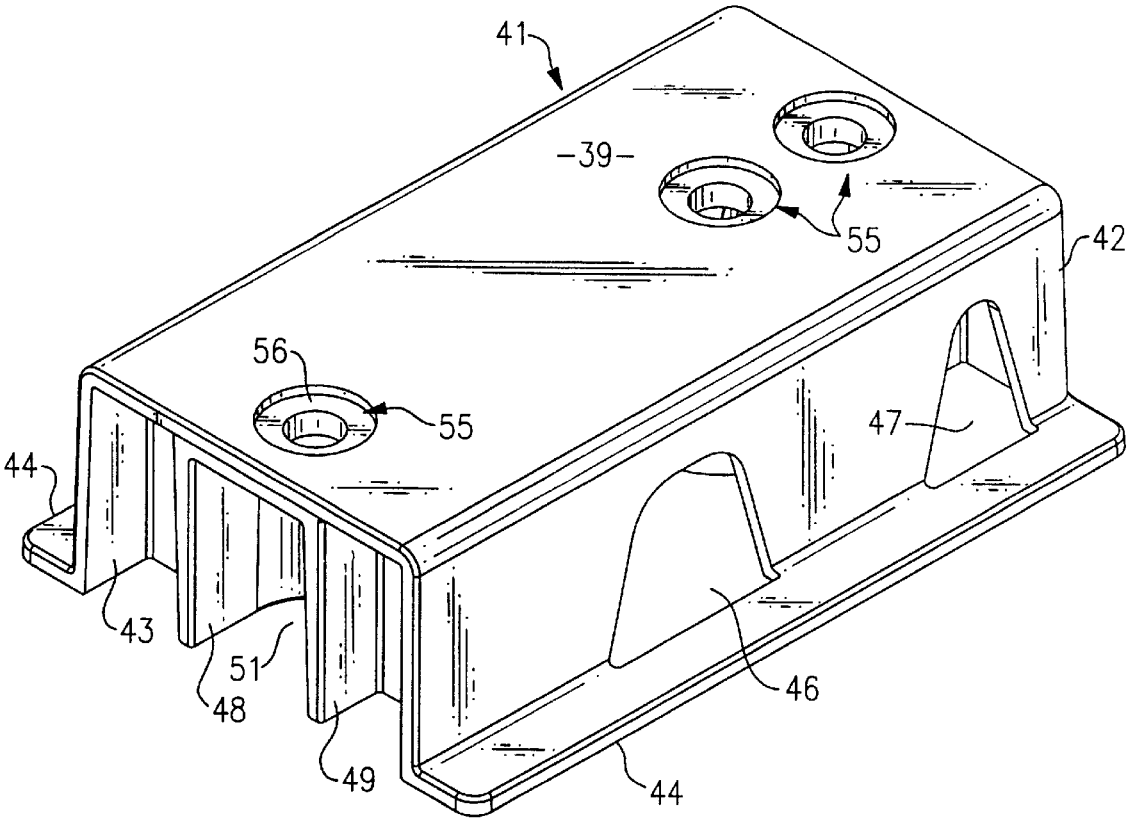
FIG. 5 is an enlarged perspective view showing one of the reinforcing support members used in the present invention.

A series of reinforcing support members, generally referenced 41, are mounted within the panel cavity. Each member includes a flat horizontally disposed upper platform 39 and a plurality of walls that depend downwardly from the platform. Included in the walls are two opposed side walls 42 and 43 that extend along the side edges of the platform. Each side wall, in turn, includes an outwardly protruding tab 44 that is generally perpendicular to the side wall and which extends along the entire length of the bottom edge of the wall. A pair of generous openings 46 and 47 are provided in the side walls that open into the interior of the support member. Internal walls such as walls 48–49 shown in FIG. 5 are contained inside the support members that coact with each other and the side walls to establish internal chambers such as chamber 51 within the support member. All of the chambers open to one of the four sides of the support member, the purpose of which will be explained in greater detail below.

The height of each support member is substantially equal to the depth of the panel cavity as measured between the panel covers. In assembly, the flat platform of each member is placed in contact with one of the covers and the walls depending from the platform rest upon the opposing cover along with the side wall tabs. In practice, the members are molded of a glass filled nylon that also has a low thermal conductivity.

A plurality of cylindrical elements 55 (FIG. 4) are passed downwardly through the top of the platform. Each cylinder has an expanded head 56 that is press fitted or molded into the platform to support the body section 57 of the element in perpendicular alignment with the top surface of the platform. Each element contains an internal female thread capable of receiving a bolt or screw therein. The length of the elements is less than the height of the support member so that the element in assembly will not contact the lower cover of the panel and thus cannot provide a thermally conductive path through the panel.

In assembly, the threaded elements of each support member are placed in axial alignment with through holes 59 (FIG. 2) formed in the upper cover of the panel. This permits threaded fasteners to be passed through the cover into engagement with each of the underlying support members. The cylindrical elements can be used to attach the support members to the upper cover at a desired location and to secure a piece of equipment to the support member. A section of a mounting pad 62 for such a piece of equipment is shown in FIG. 2. The pad is secured to one of the support members using mounting bolts 64.

Once the support members are placed in a desired location within the panel cavity, a curable foam material, preferably polyurethane, is injected into the cavity to completely fill the cavity and the chambers formed in each support member. Upon curing, the foam material forms a tight bond that holds the frame components to the covers as well as the support members to both covers. Here again, the polyurethane has a low thermal conductivity and along with the frame and the support members, the panel acts as a thermal barrier to impede the flow of heat through the panel.

The panel frame contains a central upwardly extended recess 70 formed therein which encircles the entire frame. The recess is adapted to be engaged by latching mechanisms 71 mounted in the structure of the framework that is designed to lock the panel within an opening in the framework.

Figure 6:
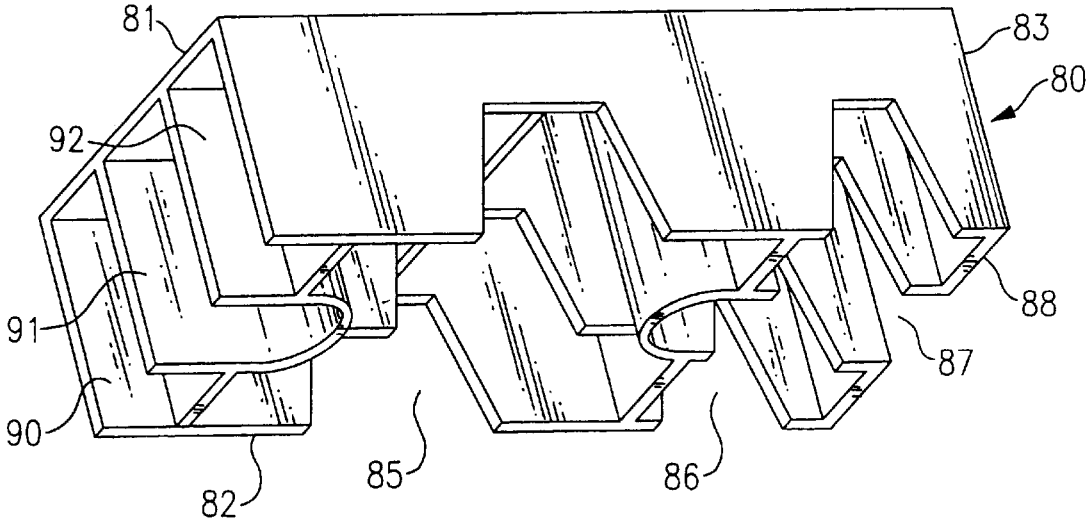
FIG. 6 is a further perspective view of another type of support member suitable for use in the practice of the present invention.

FIG. 6 illustrates another form of a reinforcing support member 80 suitable for use in the practice of the present invention. The support member includes a flat top platform 81 and a pair of side walls 82 and 83. In this embodiment, the tabs have been removed for base of molding. Openings 85 and 86 are provided in both side walls and a third opening 87 is provided in one end wall 88 to permit the foam that is injected into the cavity to flow freely into the internal chambers established between the walls. Three internal chambers 90–92 are provided at the opposite end of the member which open directly into the panel cavity.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A panel for use in an air handling unit for supporting equipment contained within the unit, said panel including a rectangular frame a top cover and a bottom cover for enclosing said frame so that a cavity of a given depth is established within the frame between the covers, a plurality of support members that are mounted within said cavity, said support members having a height about equal to said depth of said cavity, each support member having a flat upper platform that is in contact with one of said covers and a series of walls extending downwardly from said platforms and being in contact with the other of said covers, said walls coacting to establish a number of chambers within each support member all which open to a side of said support member, a curable foam material completely filling the chambers of said support members and said panel cavity which upon curing bonds the covers to the frame and to said support members, said support members and said curable foam all being formed of a material having a low thermal conductivity whereby the panel acts as a thermal barrier to the movement of heat through said panel.

2. The panel of claim 1 wherein said covers are fabricated of metal.

3. The panel of claim 2 wherein said curable foam material is a polyurethane foam.

4. The panel of claim 3 wherein said support members are fabricated of a glass filled nylon.

5. The panel of claim 4 wherein each support member contains at least one internally threaded insert that passes downwardly into the said member through said platform to a depth that is less than the height of the support member.

6. The panel of claim 5 wherein said one of said covers adjacent the support member platform has a through hole that is in axial alignment with said at least one threaded insert.

7. The panel of claim 1 wherein each support member contains opposed side walls and having tabs extending outwardly from a bottom edge of each side wall so that said tabs rest in contact with the bottom cover.

8. The panel of claim 5 wherein each support member contains a plurality of internally threaded inserts.

* * * * *